US009532431B2

(12) United States Patent
Yun

(10) Patent No.: US 9,532,431 B2
(45) Date of Patent: Dec. 27, 2016

(54) ORGANIC LIGHT-EMITTING DIODE (OLED) DISPLAY AND METHOD OF MANUFACTURING THE SAME

(71) Applicant: Samsung Display Co., Ltd., Yongin-si, Gyeonggi-do (KR)

(72) Inventor: Jong Hyun Yun, Gwangmyeong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/825,966

(22) Filed: Aug. 13, 2015

(65) Prior Publication Data

US 2016/0227624 A1 Aug. 4, 2016

(30) Foreign Application Priority Data

Feb. 2, 2015 (KR) ..... 10-2015-0016353

(51) Int. Cl.

| | |
|---|---|
| ***H01J 1/62*** | (2006.01) |
| ***H05B 33/26*** | (2006.01) |
| ***H05B 33/10*** | (2006.01) |
| ***H05B 33/14*** | (2006.01) |

(52) U.S. Cl.

CPC ..... *H05B 33/26* (2013.01); *H05B 33/10* (2013.01); *H05B 33/14* (2013.01)

(58) Field of Classification Search

CPC ..... H01L 2251/5338
USPC ..... 313/504, 506, 498
See application file for complete search history.

(56) References Cited

U.S. PATENT DOCUMENTS

| | | | | |
|---|---|---|---|---|
| 4,690,510 | A | 9/1987 | Takamatsu et al. | |
| 5,805,117 | A | 9/1998 | Mazurek et al. | |
| 5,986,622 | A | 11/1999 | Ong | |
| 6,614,171 | B2 | 9/2003 | Rajeswaran et al. | |
| 7,362,046 | B2 | 4/2008 | Aston | |
| 8,305,294 | B2 | 11/2012 | Cok et al. | |
| 2006/0157103 | A1* | 7/2006 | Sheats | H01L 27/3204 136/244 |
| 2014/0231763 | A1* | 8/2014 | Kim | H01L 27/3218 257/40 |
| 2014/0375529 | A1* | 12/2014 | Yun | G06F 3/1446 345/1.3 |

FOREIGN PATENT DOCUMENTS

| | | | |
|---|---|---|---|
| KR | 10-0496461 | B1 | 6/2005 |
| KR | 10-2008-0078632 | A | 8/2008 |
| KR | 10-2011-0023138 | A | 3/2011 |
| KR | 10-1127960 | B1 | 3/2012 |
| KR | 10-2012-0042151 | A | 5/2012 |
| KR | 10-2013-0044774 | A | 5/2013 |

* cited by examiner

*Primary Examiner* — Vip Patel
(74) *Attorney, Agent, or Firm* — Knobbe, Martens, Olson & Bear, LLP

(57) ABSTRACT

An organic light-emitting diode (OLED) display and method of manufacturing the same are disclosed. In one aspect, the OLED display includes at least two OLED display modules arranged in the same plane so as to be adjacent to each other, a connection portion bonding the adjacent OLED display modules to each other, and a flexible window substrate positioned over the OLED display modules. The OLED display modules are electrically connected to each other.

12 Claims, 13 Drawing Sheets

ORGANIC LIGHT-EMITTING DIODE (OLED) DISPLAY AND METHOD OF MANUFACTURING THE SAME

RELATED APPLICATIONS

This application claims priority to and the benefit of Korean Patent Application No. 10-2015-0016353 filed in the Korean Intellectual Property Office on Feb. 2, 2015, the entire contents of which are incorporated herein by reference.

BACKGROUND

Field

The described technology generally relates to an organic light-emitting diode (OLED) display and a method of manufacturing the same.

Description of the Related Technology

OLED displays have recently been drawing attention due to their favorable characteristics. In contrast to liquid crystal displays (LCDs), OLED displays are self-emissive, and thus, do not require a separate light source to display images. Consequently, OLED displays are manufactured with a reduced profile and weight compared to LCDs. OLED displays have additional high-quality characteristics such as low power consumption, high luminance, a high reaction speed, and the like.

Recently, ongoing research and development has been directed towards flexible OLED displays that can be bent, rolled, and stretched. Various methods for increasing the flexibility of such displays include forming a base substrate using flexible organic materials such as polyimide (PI), forming a flexible adhesive layer such as an optical clear adhesive (OCA) or pressure sensitive adhesive (PSA), or the like.

SUMMARY OF CERTAIN INVENTIVE ASPECTS

One inventive aspect is an OLED display that can be repeatedly bent, rolled, and/or stretched and a method of manufacturing the same.

Another aspect is an OLED display that can minimize the damage of an organic emission layer, an encapsulation layer, and the like even when the OLED display is repeatedly bent, rolled, or stretched, while displaying one image as an integrated image by connecting at least two OLED display modules to each other.

Another aspect is an OLED display including: at least two OLED display modules arranged on substantially the same plane to be adjacent to each other; a bonded part bonding between the adjacent OLED display modules; and flexible window substrates positioned on at least two OLED display modules, in which at least two OLED display modules each are electrically connected to each other.

The OLED display module can include: a first substrate having flexibility; an organic emission layer positioned on the first substrate; a second substrate positioned on the organic emission layer; and a support film positioned beneath the first substrate.

A cross section length of the first substrate can be formed to be greater than that of the organic emission layer and the second substrate.

The first substrate can be formed in a substantially quadrangular shape and at least one corner of the first substrate can be provided with a conductor.

The adjacent OLED display modules can be arranged so that the conductors are opposite to each other and an insulating film can be arranged between the conductors opposite to each other.

The first substrate can be bent to cover at least one side of the support film.

The organic emission layer and the second substrate can be bent together with the first substrate.

The lower portion of the first substrate can be provided with at least two grooves and the groove can have a wedge shape.

The adjacent OLED display modules can be arranged so that the bent portions of the first substrate are opposite to each other and the bonded part can bond between the bent portions of the first substrates.

The bonded part can include an amorphous conductive film.

The OLED display can further include: reinforcing films contacting the bonded part and the first substrate, respectively.

Another aspect is an OLED display, including: forming a protruding pattern on a carrier substrate; sequentially stacking a first substrate, an organic emission layer, and a second substrate on the carrier substrate and the protruding pattern; separating the carrier substrate and the protruding pattern from the first substrate; arranging the first substrate on a support film; cutting the support film based on a position of the groove formed beneath the first substrate; and completing the OLED display module by bending the first substrate, the organic emission layer, and the second substrate toward a side of the support film along the groove.

The method can further include: arranging at least two completed OLED display modules on substantially the same plane to be adjacent to each other; and bonding the adjacent OLED display modules.

The method can further include: attaching a flexible window substrate to the upper portions of at least two bonded OLED display modules.

Another aspect is an OLED display comprising at least two OLED display modules arranged in the same plane so as to be adjacent to each other; a connection portion bonding the adjacent OLED display modules to each other, and a flexible window substrate positioned over the OLED display modules, wherein the OLED display modules are electrically connected to each other.

In exemplary embodiments, each of the OLED display modules includes a first substrate; an organic emission layer formed over the first substrate; a second substrate formed over the organic emission layer; and a support film positioned below the first substrate. A cross sectional length of the first substrate can be greater than that of the organic emission layer and the second substrate. The first substrate can have a substantially quadrangular shape, and at least one corner of the first substrate can comprise a conductive area. The adjacent OLED display modules can be arranged so that the conductive areas oppose each other and an insulating film can be interposed between the opposing conductive areas.

In exemplary embodiments, the first substrate is bent so as to cover at least one side of the support film. The organic emission layer and the second substrate can be bent together with the first substrate. At least two grooves can be defined in the lower portion of the first substrate. Each of the grooves can have a substantially triangular cross-section.

In exemplary embodiments, the adjacent OLED display modules are arranged so that the bent portions of the first substrates oppose each other and the connection portion is interposed between the bent portions of the first substrates. The bonded part can include an amorphous conductive film. The OLED display can further comprise at least two reinforcing films, each contacting the connection portion and a corresponding one of the first substrates.

Another aspect is a method of manufacturing an OLED display comprising forming a protruding pattern over a carrier substrate; sequentially stacking a first substrate, an organic emission layer, and a second substrate over the carrier substrate and the protruding pattern, wherein the first substrate has at least one groove defined therein; separating the carrier substrate and the protruding pattern from the first substrate; arranging the first substrate over a support film; cutting the support film based on the location of the groove; and bending the first substrate, the organic emission layer, and the second substrate toward a side of the support film along the groove so as to form an OLED display module.

In exemplary embodiments, the method further comprises arranging at least two OLED display modules on the same plane so as to be adjacent to each other; and bonding the adjacent OLED display modules to each other. The method can further comprise attaching a flexible window substrate to upper portions of the bonded OLED display modules.

According to at least one exemplary embodiment, the OLED display includes at least two OLED display modules arranged on substantially the same plane to control each OLED display module to display the integrated image and can physically connect the adjacent OLED display modules to elastically deform the OLED display modules, such that the OLED display can be easily stretched, bent, or rolled, thereby minimizing the damage of the organic emission layer, the encapsulation layer, and the like even when the OLED display is repeatedly bent, rolled, or stretched.

Further, according to at least one exemplary embodiment, the OLED display can electrically connect between the adjacent OLED display modules and thus does not require a separate panel for supplying the driving power to each of the OLED display modules unlike the general tile-type display device, thereby forming the OLED display to have a thin profile.

DETAILED DESCRIPTION OF CERTAIN INVENTIVE EMBODIMENTS

Figure 1:
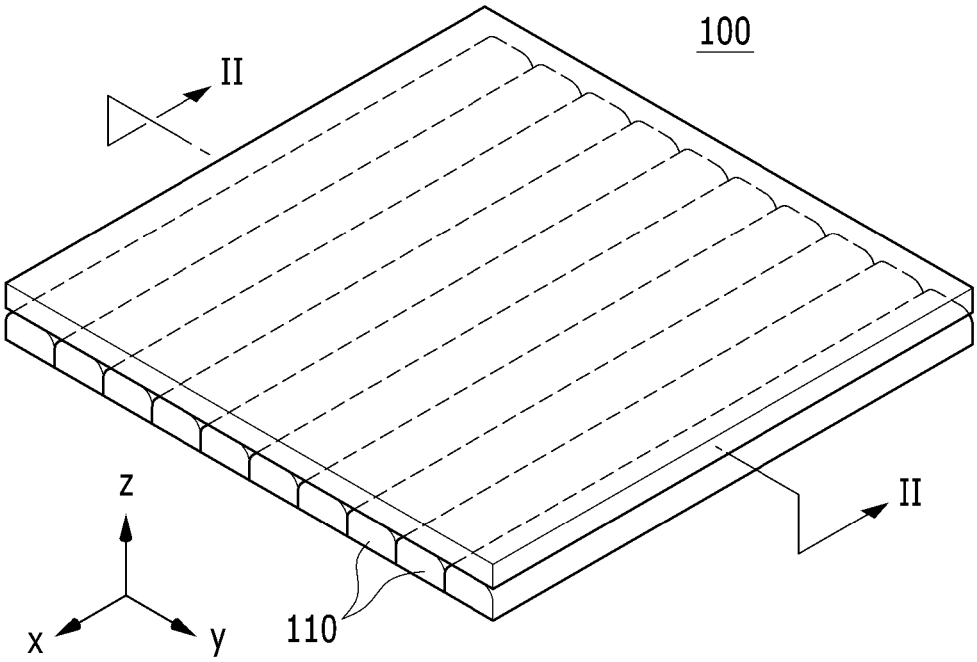
FIG. 1 is a perspective view schematically illustrating an OLED display according to an exemplary embodiment.

When flexible OLED displays are repeatedly bent, rolled, or stretched, stress is concentrated on localized areas of the display. As a result, organic emission layers, encapsulation layers, and the like, which are formed over a flexible substrate in the localized areas are more prone to being damaged due to the increased stress in the localized areas.

In the following detailed description, only certain exemplary embodiments have been shown and described, simply by way of illustration. As those skilled in the art would realize, the described embodiments may be modified in various different ways, all without departing from the spirit or scope of the described technology. The drawings and description are to be regarded as illustrative in nature and not restrictive. Like reference numerals designate like elements throughout the specification.

Further, in the specification, the word "on" generally refers to positioning on or below a specified object, but does not necessarily mean positioning on the upper side of the object with respect to the ground or z-axis.

In addition, the sizes and thicknesses of elements shown in the drawings may be exaggerated to facilitate the understanding and ease of description, but the described technology is not limited thereto.

In addition, unless explicitly described to the contrary, the word "comprise" and variations such as "comprises" or "comprising", will be understood to imply the inclusion of stated elements but not the exclusion of any other elements.

First, a schematic configuration of an OLED display according to an exemplary embodiment will be described with reference to FIG. 1.

FIG. 1 is a perspective view schematically illustrating an OLED display according to an exemplary embodiment.

The OLED display 100 according to an exemplary embodiment includes at least two OLED display modules 110. The OLED display 100 can be a tile-type display device which can display one image on each OLED display module 110 and combing the images to form an integrated image by arranging at least two OLED display modules 110 to be adjacent to each other. As illustrated in FIG. 1, in the OLED display 100, at least two OLED display modules 110 can be arranged on substantially the same plane (e.g., the x-y plane shown in FIG. 1) along a y-axis direction.

At least two OLED display modules 110 each have a bar-shaped structure which extends in one-axis direction. Each of the OLED display modules 110 can emit an image in the Z-axis direction of FIG. 1. According to the exemplary embodiment, the OLED display 100 has a structure in which at least two adjacent OLED display modules 110 are arranged along the y-axis direction of FIG. 1 but the scope of the exemplary embodiment is not necessarily limited thereto, and therefore, the OLED display 100 can have various tile-type structures in which one image can be displayed on each OLED display module 110 to form an integrated image, such as a structure in which the OLED display modules 110 adjacent to each other in the x-axis and y-axis directions of FIG. 1 are connected to each other.

Hereinafter, a detailed configuration of an OLED display module according to an exemplary embodiment will be described with reference to FIGS. 2 to 5.

Figure 2:
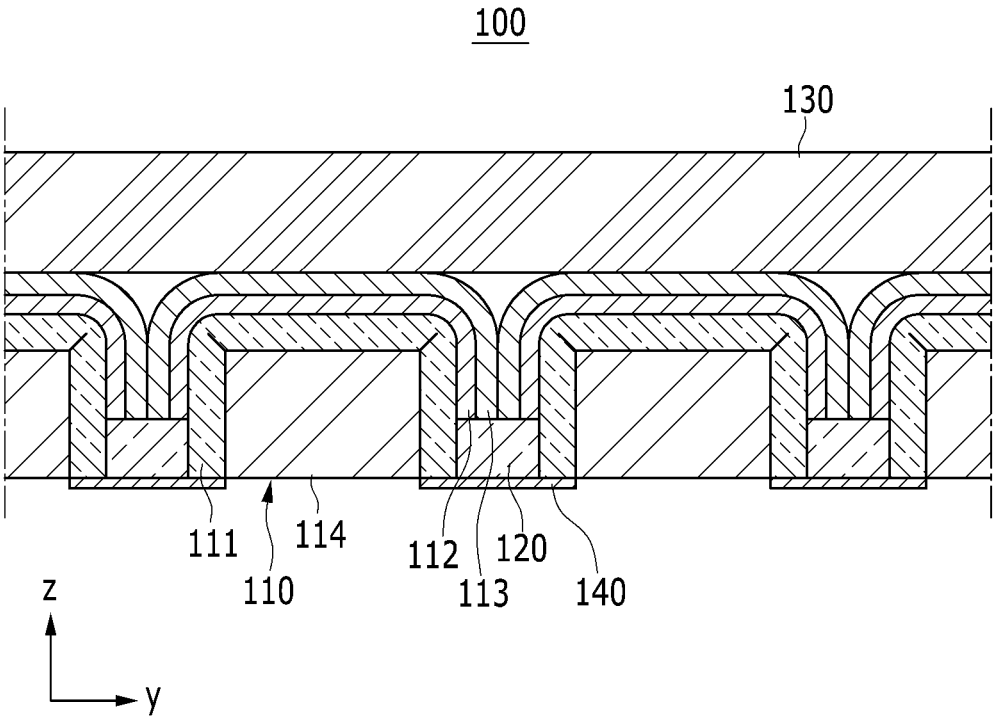
FIG. 2 is a cross-sectional view taken along line II-II of FIG. 1.
Figure 3:
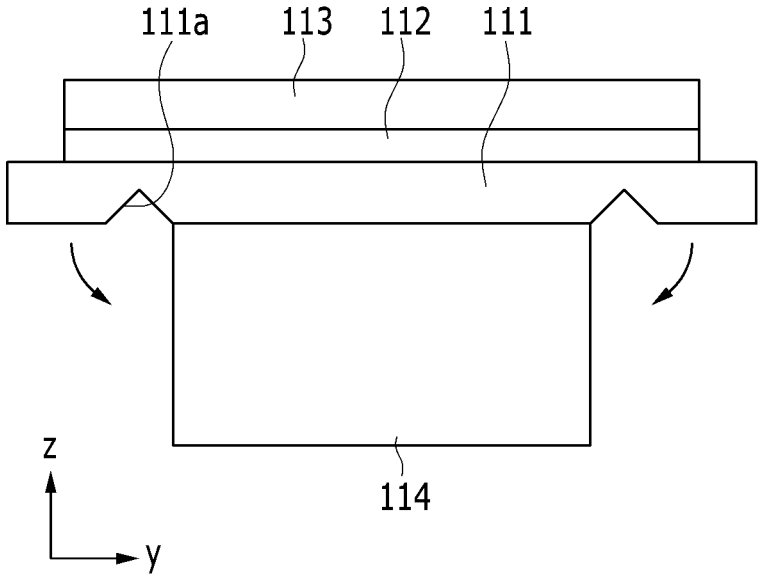
FIG. 3 is a cross-sectional view illustrating an OLED display of the OLED display according to the exemplary embodiment.
Figure 4:
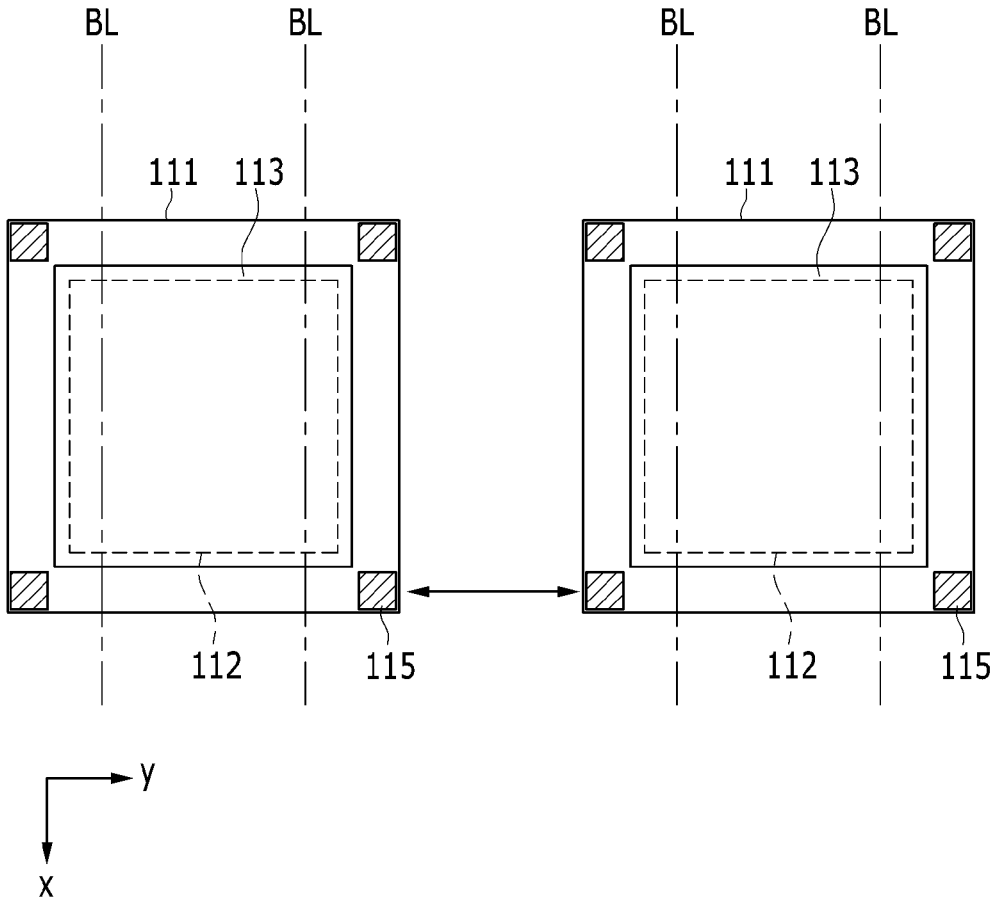
FIG. 4 is a plan view of a pair of adjacent OLED display modules of the OLED display according to the exemplary embodiment.

FIG. 2 is a cross-sectional view taken along line II-II of FIG. 1, FIG. 3 is a cross-sectional view illustrating an OLED display module of the OLED display according to the exemplary embodiment, and FIG. 4 is a plan view of a pair of adjacent OLED display modules of the OLED display according to the exemplary embodiment.

The OLED display 100 further includes a bonded part or connection portion 120, a flexible window substrate 130, and a reinforcing film 140, in addition to at least two OLED display modules 110.

As illustrated in FIG. 2, at least two OLED display modules 110 are arranged to be adjacent to each other along the y-axis direction. In more detail, each of the OLED display modules 110 includes a first substrate 111, an organic emission layer 112, a second substrate 113, a support film 114, and a conductor or conductive area 115.

In some embodiments, the substrate 111 is formed as a substantially quadrangular insulating substrate formed of glass, quartz, ceramic, metal, plastic, or the like. As illustrated in FIG. 3, the first substrate 111 can be formed of flexible plastic materials such as polyimide so that the first substrate 111 can be bent based along one axis as a rotation center axis. According to the exemplary embodiment, two opposing ends of the first substrate 111 can be bent to cover opposing sides of the support film 114.

Meanwhile, the first substrate 111 can include grooves 111*a* provided on one surface thereof.

As illustrated in FIG. 3 the groove 111*a* can be formed on a lower surface of the first surface 111 to have a substantially triangular wedge shape. At least two grooves 111*a* can be formed on the lower surface of the first substrate 111 to be spaced apart from each other at a predetermined interval. In the embodiments of FIG. 3, the grooves 111*a* are formed at a position of the lower surface of the first substrate 111 along at least a portion of opposing ends of the support film 114. The grooves 111*a* can along extend along the entire surface of the opposing ends of the support film 114.

According to the exemplary embodiment, due to the formation of the grooves 111*a*, there is a difference in thickness between a point at which the groove 111*a* is formed in the first substrate 111 and a point at which the groove 111*a* is not formed. Accordingly, when the first substrate 111 is bent, the first substrate 111 can be bent along an arrow direction of FIG. 3 based on the point at which the groove 111*a* is formed due to the bending stress. Therefore, the bending stress applied to the first substrate 111 is concentrated at each of the points at which the grooves 111*a* are formed on the first substrate 111, and thus as illustrated in FIG. 2, the ends of the first substrate 111 are easily bent so as to respectively cover the sides of the support film 114.

However, the scope of the exemplary embodiment is not limited thereto, but the shape, number, and arrangement of the grooves 111*a* can be variously designed depending on the final shape of the OLED display module 110 or the OLED display 100.

The organic emission layer 112 is positioned on the first substrate 111 and can include an organic layer, or the like, which emits light having various colors such as red, green, blue, and/or white. Further, although not illustrated, pixel circuits which include wirings, for example, signal lines including at least one scan line, a data line, a driving power supply line, a common power supply line, or the like can be formed on or beneath the organic emission layer 112. The pixels circuits can also include at least two thin film transistors (TFTs), and at least one capacitor connected to the wirings.

The second substrate 113 is formed on the organic emission layer 112. In some embodiments, the second substrate 113 is an insulating substrate which is formed of glass, quartz, ceramic, metal, plastic, or the like. The second substrate 113 can be formed of a plurality of organic layers, a plurality of inorganic layers, and/or a thin film encapsulation layer on which the inorganic layers or the organic layers are alternately stacked to prevent moisture, gas, and the like, from penetrating into the organic emission layer 112. Similar to the first substrate 111, the second substrate 113 can be formed of a flexible material.

Meanwhile, according to the exemplary embodiment, the cross sectional length of the first substrate 111 can be longer than that of the organic emission layer 112 and the second substrate 113. That is, as illustrated in FIG. 4, the organic emission layer 112 and the second substrate 113 can be formed to have a smaller area than that of the first substrate 111. Therefore, it is possible to prevent defects such as cracks from occurring at a corner region of the first substrate 111 in the organic emission layer 112 and the second substrate 113. The wiring unit (not illustrated) for driving the organic emission layer 112 can be formed at an area where the organic emission layer 112 and the second substrate 113 in the first substrate 111 are not formed.

The support film 114 is positioned beneath the first substrate 111 to support the first substrate 111, the organic emission layer 112, and the lower portion of the second substrate 113. The support film 114 can have a smaller area than that of the first substrate 111. Therefore, as illustrated in FIG. 3, the first substrate 111 can be bent to enclose the sides of the support film 114 based on the grooves 111*a*.

In some embodiments, the support film 114 is formed to have a thickness that is greater than that of the first substrate 111 and thus the first substrate 111 can be bet to cover only a portion of the sides of the support film 114. As illustrated in FIG. 2, the organic emission layer 112 and the second substrate 113 can also be bent along with the first substrate 111. That is, the area of the organic emission layer 112 and the second substrate 113 can be greater than that of the support film 114, and thus, the first substrate 111, the organic emission layer 112, and the second substrate 113 can be simultaneously bent along a bending line BL as shown in FIG. 4.

When the OLED display modules 110 are bent along the bending line BL and arranged to be adjacent to each other as described above, the bent portions of the second substrates 113 opposing to each other can contact each other and a space is formed between the portions where the organic emission layers 112 and the second substrates 113 in the first substrates 111 opposing each other are not formed as illustrated in FIG. 2.

Figure 5:
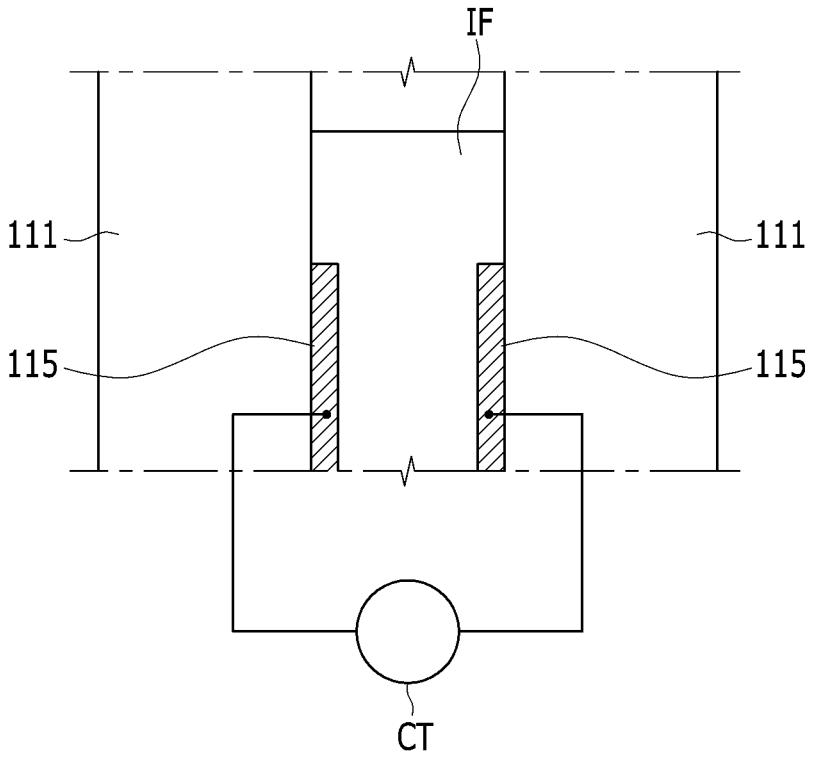
FIG. 5 is a cross-sectional view illustrating an insulating film which is interposed between the pair of adjacent OLED display modules of the OLED display according to the exemplary embodiment.

FIG. 5 is a cross-sectional view illustrating an insulating film which is interposed between the pair of OLED display modules adjacent to each other in the OLED display according to the exemplary embodiment.

The conductors 115 can be arranged on each corner of the first substrate 111. The first substrate 111, the organic emission layer 112, and the second substrate 113 can be bent along the bending line BL of FIG. 4, and thus, the conductors 115 arranged between the adjacent OLED display modules are placed at positions opposite to each other. According to the exemplary embodiment, as illustrated in FIG. 5, an insulating film IF is interposed between the opposing conductors 115 and the opposing conductors 115 can be connected to a circuit tester CT. As a result, when the insulating film IF is damaged by bending, rolling, and/or stretching of the OLED display 100 to a critical stress or greater, a change in the voltage between the opposing conductors 115 due to the damage to the insulating film IF can be measured in real time. Accordingly, it can be determined whether the adjacent OLED display modules 110 are spaced apart from each other.

Hereinafter, a detailed configuration of the bonded part, the flexible window substrate, and the reinforcing film according to the exemplary embodiment will be described with reference again to FIG. 2.

The bonded part 120 bonds the adjacent OLED display modules 110 to each other. According to the exemplary embodiment, when at least two OLED display modules 110 are bent along the bending line BL of FIG. 4 as described above and arranged to be adjacent to each other, as illustrated in FIG. 2, the bonded part 120 can be formed to fill the space between the portions where the organic emission layers 111 and the second substrates 113 in the first substrates 111 opposing each other are not arranged. The bonded part 120 can include an amorphous conductive film (ACF) to electrically connect the opposing first substrates 111 to each other.

As described above, even when the OLED display 110 is bent, stretched, and/or extended, by physically and electrically connecting the adjacent OLED display modules 110 using the bonded part 120, it is possible to omit a separate panel for supplying a driving power to each of the OLED display modules 110 while preventing the adjacent OLED display modules 110 from being spaced from each other, thereby reducing the thickness of the OLED display 100.

As illustrated in FIG. 2, the flexible window substrate 130 can be arranged to completely cover the upper portions of at least two OLED display modules 110 arranged to be adjacent to each other on substantially the same plane. According to the exemplary embodiment, similar to the first substrate 111, the flexible window substrate 130 can be formed of flexible materials, such that the OLED display 100 can be bent, rolled, and/or stretched.

As illustrated in FIG. 2, the reinforcing film 140 can contact the bonded part 120 and the opposing first substrates 111. The reinforcing film 140 is bonded to both of the bonded part 120 and the opposing first substrates 111 to reinforce the adhesion of the bonded part 120. That is, when the OLED display 100 is bent, rolled, and/or stretched over the adhesion of the bonded part 120, the reinforcing film 140 can also prevent the adjacent OLED display modules 110 from being spaced apart from each other due to the damage of the bonded part 120.

Hereinafter, the stress distribution inside the OLED display and the change of the OLED display depending thereon when the OLED display according to the exemplary embodiment is stretched or bent will be described with reference to FIGS. 6 and 7.

Figure 6:
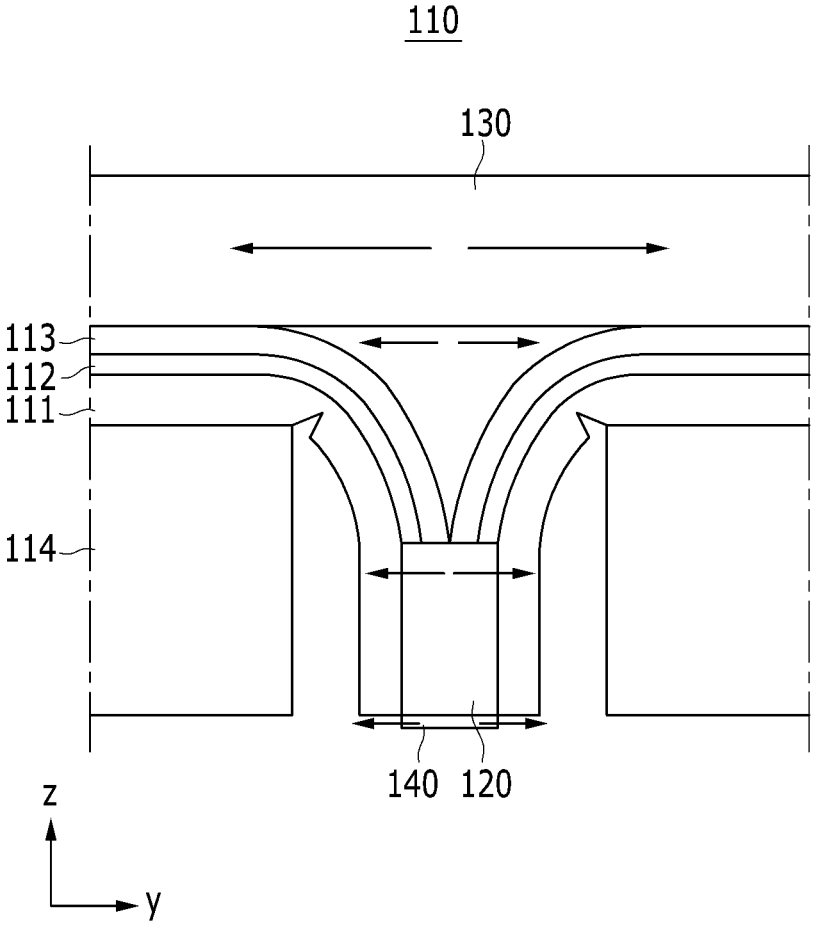
FIG. 6 is a diagram illustrating stress distribution in the OLED display when the OLED display according to the exemplary embodiment is stretched.

FIG. 6 is a diagram illustrating the stress distribution of the OLED display when the OLED display according to the exemplary embodiment is stretched. FIG. 7 is a diagram illustrating an internal change in the OLED display when the OLED display according to the exemplary embodiment is bent.

The types of external force directly applied to the OLED display 100 according to the exemplary embodiment can be largely divided into tensile forces, e.g., where the OLED display is tensioned by being pulled to both sides (case of FIG. 6) and bending forces, where the OLED display is bent based on one axis as the rotation center axis (case of FIG. 7) to be folded and/or rolled.

The exemplary embodiment discloses a structure in which the organic emission layer 112 and the second substrate 113 are partially bent toward the sides of the support film 114, and thus, when the OLED display 100 is simply used as illustrated in FIG. 2 described above, it can be difficult to observe images displayed from the opposing sides of the support film 114 on the organic emission layer 112. Therefore, as illustrated in FIG. 6, the first substrates 111, the organic emission layers 112, and the second substrates 113 of the adjacent OLED display modules are maintained at predetermined intervals from each other by pulling both surfaces of the OLED display 100 from each other, such that it the images displayed from the opposing sides of the support film 114 of the organic emission layer 112 can be observed.

When both surfaces of the OLED display 100 are tensioned by being pulled from each other in the y axis as shown in FIG. 6, the flexible window substrate 130, the first substrate 111, the organic emission layer 112, the second substrate 113, the bonded part 120, and the reinforcing film 140 inside the OLED display 100 are each applied with the stress due to the tension as illustrated by the arrows in FIG. 6.

The flexible window substrate 130 is primarily applied with a tensile stress in an arrow direction due to the tension, the first substrate 111, the organic emission layer 112, and the second substrate 113 in the OLED display modules which are adjacent to each other and each contact the flexible window substrate 130 are spaced apart from one another in an arrow direction due to the primary tensile stress. The bonded part 120 is applied with a secondary tensile stress that is less than the primary tensile stress and the reinforcing film 140 is applied with a tertiary tensile stress that is less than the secondary tensile stress.

As illustrated in FIG. 6, according to the exemplary embodiment, when the tensile stress is applied, the first substrate 111 can be elastically deformed while being spaced from the side of the support film 114. As described above, a portion of the primary tensile stress creates a space between the first substrate 111 and the support film 114 and elastically deforms the first substrate 111, thereby further reducing the secondary stress applied to the bonded part 120 compared to a structure in which the first substrate 111 is bonded to the side of the support film 114.

Further, according to the exemplary embodiment, when the bonded part 120 is damaged due to the secondary stress, as illustrated in FIG. 5 described above, it can be determined whether there is a space between the adjacent OLED display modules using the conductors 115 that are arranged to be opposite to each other between the adjacent OLED display modules, such that it can be determined whether the OLED display 100 is damaged due to the application of the tensile stress.

Figure 7:
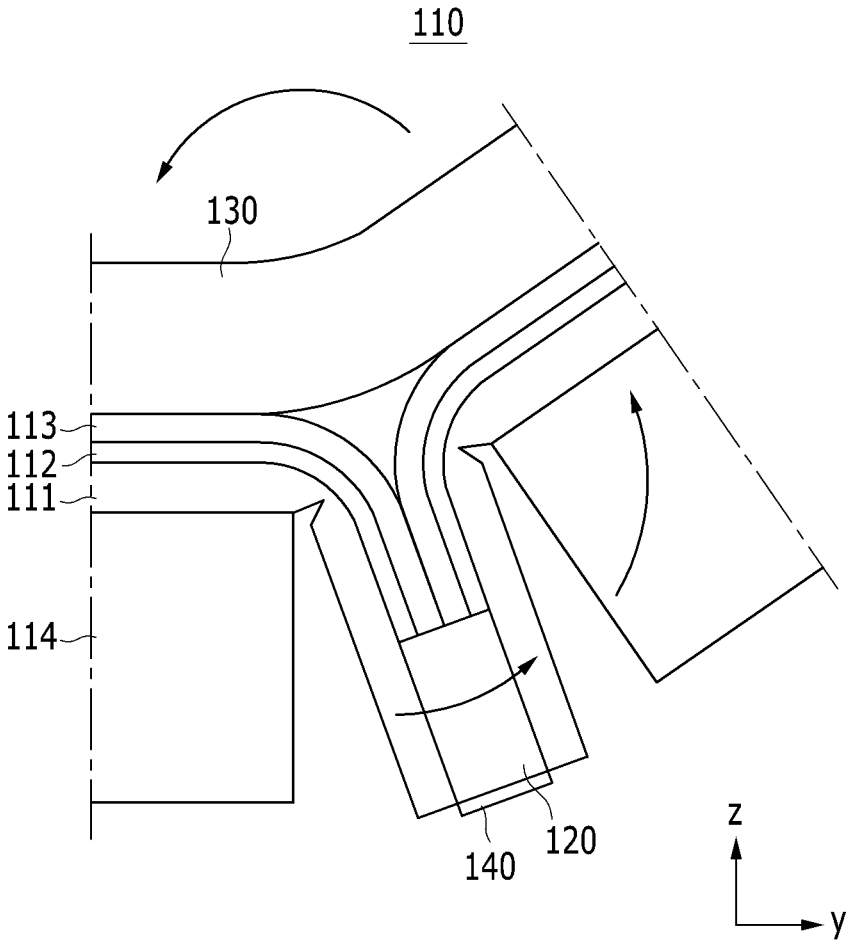
FIG. 7 is a diagram illustrating an internal change in the OLED display when the OLED display according to the exemplary embodiment is bent.

Meanwhile, when the OLED display 100 is bent in a direction having a rotation axis that is perpendicular to both of the y axis and the z as shown in FIG. 7, the flexible window substrate 130, the first substrate 111, the organic emission layer 112, and the second substrate 113 are elastically deformed due to the bending.

The flexible window substrate 130 can be elastically deformed to be bent in an arrow direction of FIG. 7 and the first substrate 111 can also be elastically deformed to be spaced apart from the side of the support film 114 in an arrow direction. The organic emission layer 112 and the second substrate 113 are positioned on the first substrate 111, and therefore, can be elastically deformed together depending on the elastic deformation of the first substrate 111.

According to the exemplary embodiment, the first substrate 111 can be spaced apart from the side of the support film 114 and therefore the space between the adjacent OLED display modules is set as the position of the rotation center axis to easily bend the OLED display 100. That is, according to the exemplary embodiment, each of at least two adjacent OLED display modules can be bent, and therefore, any one portion of the OLED display 100 can be simply folded and the OLED display 100 can be stored after being rolled.

As described above, in the OLED display 100 according to the exemplary embodiment, the adjacent OLED display modules 110 are physically connected to each other, however, an elastic deformation can occurs between the adjacent OLED display modules 110, and as a result, the OLED display 100 can be stretched, bent, or rolled.

Further, the base substrate, the organic emission layer, and the encapsulation layer of the standard flexible display are elastically deformed directly and repeatedly by the external force, but in the OLED display 100 according to at least one exemplary embodiment, only the portion of the flexible window substrate 130 is elastically deformed directly and repeatedly and the first substrate 111, the organic emission layer 112, and the second substrate 113 are elastically deformed indirectly. Accordingly, even when the OLED display 100 is repeatedly bent, rolled, or stretched, the damage of the organic emission layer 112 and the second substrate 113 can be minimized.

Hereinafter, a method of manufacturing an OLED display according to an exemplary embodiment will be described with reference to FIGS. 8 to 13. Depending on embodiments, additional states may be added, others removed, or the order of the states changed in the procedure of FIG. 8. This applies to the remaining method embodiments.

Figure 8:
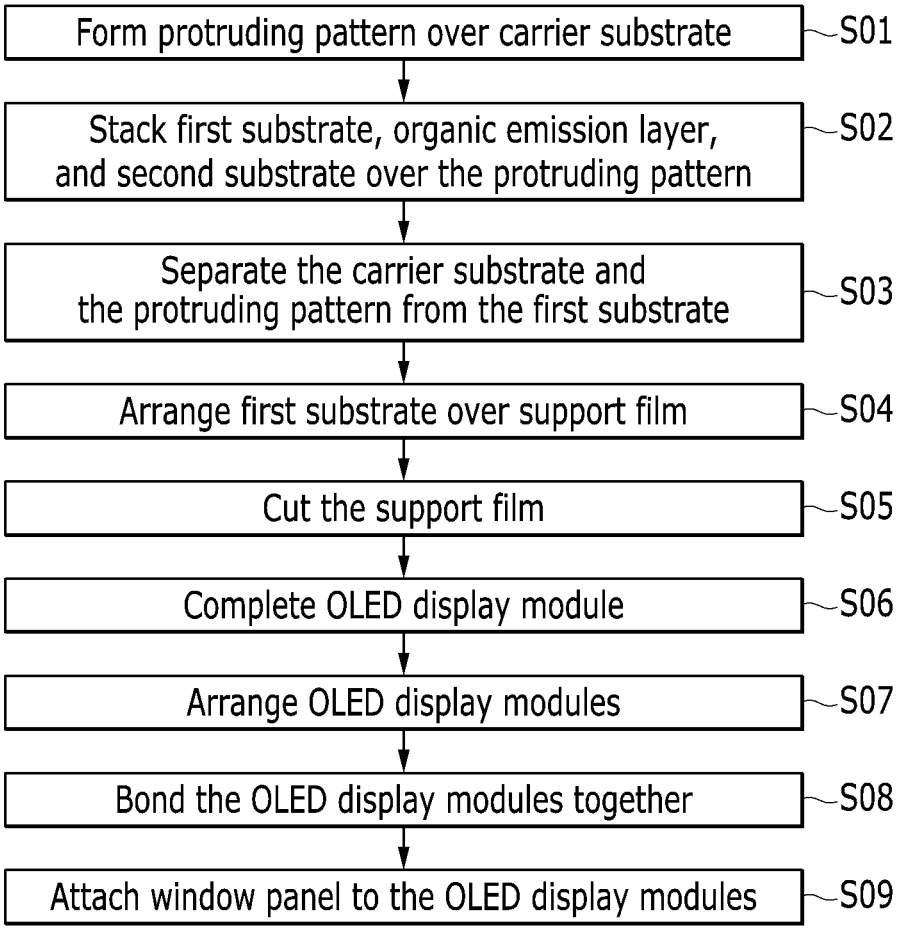
FIGS. 8 to 13 are diagrams illustrating a method of manufacturing an OLED display according to an exemplary embodiment.

Referring to FIG. 8, the method of manufacturing an OLED display according to the exemplary embodiment includes a process of manufacturing an OLED display module which includes forming a protruding pattern on a carrier substrate (S01), sequentially stacking the first substrate, the organic emission layer, and the second substrate on the carrier substrate and the protruding pattern (S02), and separating the carrier substrate and the protruding pattern from the first substrate (S03). The process further includes arranging the first substrate on the support film (S04) and cutting the support film based on the position of the groove which is formed beneath the first substrate (S05). The OLED display module is completed by bending the first substrate, the organic emission layer, and the second substrate toward the sides of the support film along the grooves (S06). The process further includes connecting a module which includes arranging at least two completed OLED display modules on substantially the same plane to be adjacent to each other (S07), bonding the adjacent OLED display modules to each other (S08), and attaching the flexible window substrate on at least two OLED display modules which are arranged on substantially the same plane to be adjacent to each other (S09).

Figure 9:
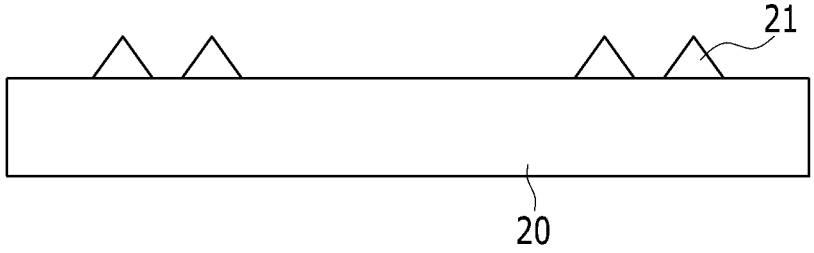

In the forming of the protruding pattern (S01), as illustrated in FIG. 9, a triangular protruding pattern 21 is formed on the carrier substrate 20 which is formed as a substantially flat plate formed of glass, metal, plastic, or the like. At least two protruding patterns 21 can be formed at a predetermined interval. The protruding pattern 21 is used to form a lower groove 111*a* in the first substrate 111 as shown in FIG. 3 and described above and can be formed of materials which do not chemically react with the first substrate 111, such as silicon oxide (SiOx) so as to be separated simultaneously with the separating of the carrier substrate 20 from the first substrate 110.

Figure 10:
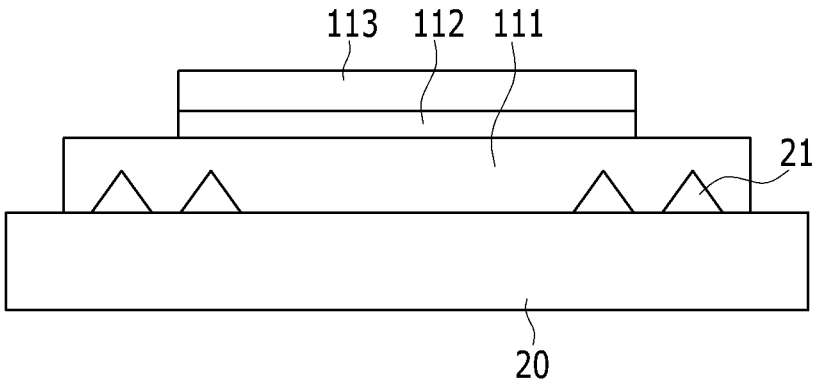

In the stacking of the first substrate, the organic emission layer, and the second substrate (S02), as illustrated in FIG. 10, the first substrate 111 is formed on the carrier substrate 20 and the protruding pattern 21 and the organic emission layer 112 and the second substrate 113 are sequentially formed on the first substrate 111. According to the exemplary embodiment, at the time of forming the first substrate 111, a flexible plastic resin such as polyimide is applied and hardened on the first substrate 111, such that the organic emission layer 112 and the second substrate 113 are stacked with the protruding pattern 21 arranged beneath the first substrate 111. Meanwhile, a cross sectional length of the first substrate 111 can be formed to be greater than that of the organic emission layer 112 and the second substrate 113.

Figure 11:
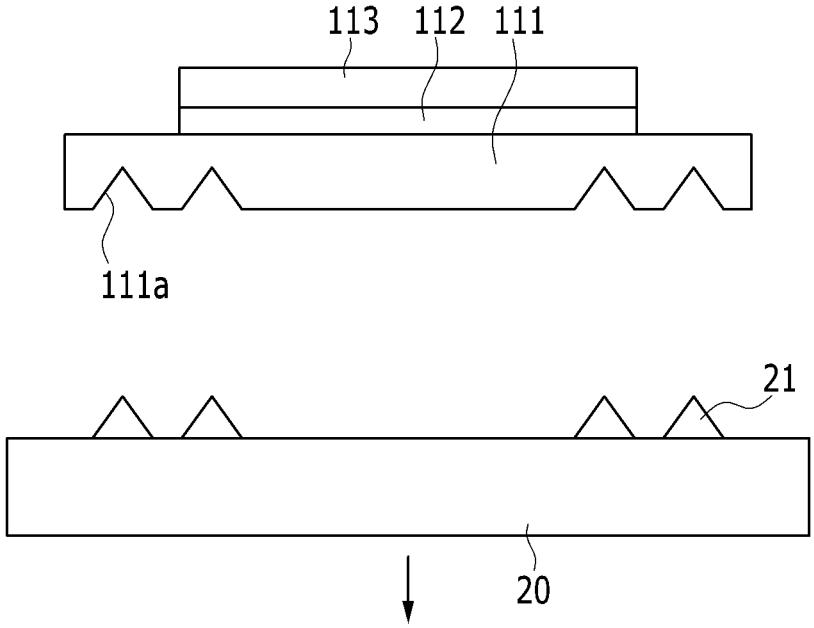

In the separating of the carrier substrate and the protruding pattern from the first substrate (S03), as illustrated in FIG. 11, after the stacking of the first substrate 111, the organic emission layer 112, the second substrate 113 is completed, the carrier substrate 20 and the protruding pattern 21 are separated from the lower portion of the first substrate 111. Therefore, the position where the protruding pattern 21 was in contact with the first substrate 111 contains the groove 111*a*.

Figure 12:
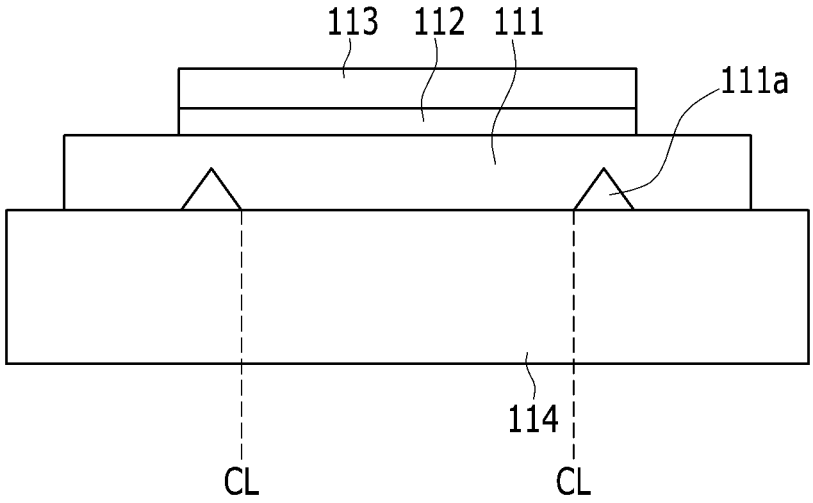

In the arranging of the first substrate on the support film S04, as illustrated in FIG. 12, the support film 114 is arranged beneath the first substrate 111. The upper portion of the support film 114 and the lower portion of the first substrate 111 on which the groove 111*a* is not formed adhere to each other and thus can be fixed to each other.

In the cutting of the support film S05, as illustrated in FIG. 12, a cutting line CL is set based on the position of the groove 111*a* and the support films 114 can each be cut along the cutting line CL.

Figure 13:
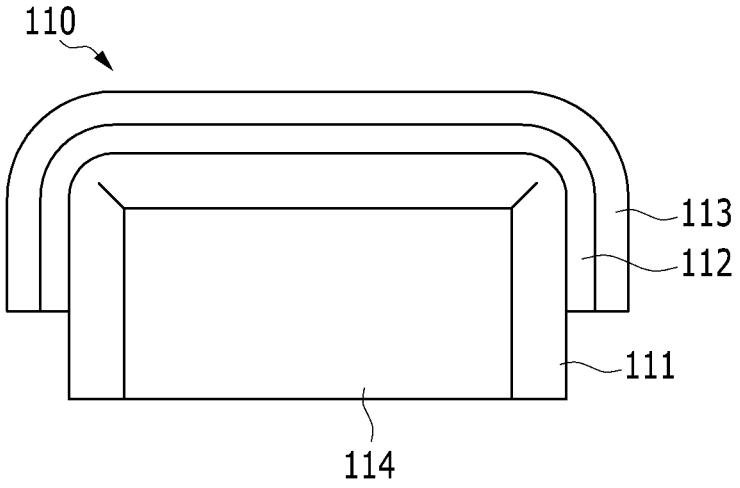

In the completing of the OLED display module (S06), as illustrated in FIG. 13, the first substrate 111, the organic emission layer 112, and the second substrate 113 can be bent toward the sides of the support film 114 through the use of the groove 111*a*. According to the exemplary embodiment, the cross sectional length of the organic emission layer 112 and the second substrate 113 is greater than the distance between the adjacent grooves 111*a*, and thus the sides of the organic emission layer 112 and the second substrate 113 can be bent toward the sides of the support film 114 together with the first substrate 111.

One OLED display module 110 can be manufactured by the above-mentioned steps and at least two OLED display modules 110 can be manufactured by repeatedly performing these steps.

Meanwhile, as a process of connecting at least two OLED display modules 110 manufactured by the foregoing method to each other, first, in the arranging of the OLED display modules (S07), at least two OLED display modules 110 manufactured by repeating the completing of the OLED display module (S06) described above are arranged on substantially the same plane so as to be adjacent to each other. That is, as illustrated in FIG. 1 described above, the OLED display modules 110 can be arranged on the x-y plane to be adjacent to each other.

Next, in the bonding of the OLED display modules (S08), the adjacent OLED display modules 110 arranged in the arranging of the OLED display modules (S07) are bonded to each other by the bonded part 120 including the amorphous conductive film. When at least two OLED display modules 110 bent along the bending line BL of FIG. 4 described above are arranged to be adjacent to each other, as illustrated in FIG. 2 described above, the bonded part 120 can be formed to fill the space between the portions where the organic emission layers 111 and the second substrates 113 in the first substrates 111 opposing each other are not arranged.

Finally, in the attaching of the flexible window substrate to the OLED display modules (S09), the flexible window substrate 130 is attached to at least two OLED display modules to contacts the upper portions of the OLED display modules 110 bonded to each other in the bonding of the OLED display modules described above (S08). As a result, the OLED display 100 as illustrated in FIG. 1 can be manufactured.

According to the method of manufacturing an OLED display as described above, the OLED display modules 110 in which the organic emission layer 112 and the second substrate 113 are partially bent toward sides of the support film 114 are arranged on substantially the same plane and are physically and electrically connected to each other, thereby manufacturing the OLED display 100 controlling each OLED display module 110 to display the integrated image.

As described above, according to an exemplary embodiment, the OLED display 100 can arranged the OLED display modules, in which the organic emission layer 112 and the second substrate 113 are partially bent toward sides of the support film 114, on substantially the same plane to control each OLED display module 110 to display an integrated image and can physically connect the adjacent OLED display modules 110 to elastically deform the OLED display modules, such that the OLED display 100 can be easily stretched, bent, or rolled.

Further, according to an exemplary embodiment, the OLED display 100 can electrically connect the adjacent OLED display modules 100 and thus does not require a separate panel for supplying the driving power to each of the OLED display modules 100 in contrast to the standard tile-type display device, thereby forming the OLED display 100 to have a thin profile.

According to an exemplary embodiment, the OLED display can arranged at least two OLED display modules on substantially the same plane to control each OLED display module to display the integrated image and can physically connect the adjacent OLED display modules to elastically deform the OLED display modules, such that the OLED display can be easily stretched, bent, or rolled.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light-emitting diode (OLED) display, comprising:

at least two OLED display modules arranged in the same plane so as to be adjacent to each other, a connection portion bonding the adjacent OLED display modules to each other; and a flexible window substrate positioned over the OLED display modules, wherein the OLED display modules are electrically connected to each other.

2. The OLED display of claim 1, wherein each of the OLED display modules includes:

a first substrate;

an organic emission layer formed over the first substrate;

a second substrate formed over the organic emission layer; and a support film positioned below the first substrate.

3. The OLED display of claim 2, wherein a cross sectional length of the first substrate is greater than that of the organic emission layer and the second substrate.

4. The OLED display of claim 2, wherein the first substrate has a substantially quadrangular shape, and wherein at least one corner of the first substrate comprises a conductive area.

5. The OLED display of claim 4, wherein the adjacent OLED display modules are arranged so that the conductive areas oppose each other and wherein an insulating film is interposed between the opposing conductive areas.

6. The OLED display of claim 2, wherein the first substrate is bent so as to cover at least one side of the support film.

7. The OLED display of claim 6, wherein the organic emission layer and the second substrate are bent together with the first substrate.

8. The OLED display of claim 6, wherein at least two grooves are defined in the lower portion of the first substrate.

9. The OLED display of claim 8, wherein each of the grooves has a substantially triangular cross-section.

10. The OLED display of claim 6, wherein the adjacent OLED display modules are arranged so that the bent portions of the first substrates oppose each other and the connection portion is interposed between the bent portions of the first substrates.

11. The OLED display of claim 10, wherein the bonded part includes an amorphous conductive film.

12. The OLED display of claim 10, further comprising at least two reinforcing films, each contacting the connection portion and a corresponding one of the first substrates.

* * * * *